United States Patent [19]

Ems

[11] Patent Number: 5,042,653

[45] Date of Patent: Aug. 27, 1991

[54] TAMPER PROOF PACKAGE

[75] Inventor: Jacob L. Ems, Floyds Knobs, Ind.

[73] Assignee: Brown & Williamson Tobacco Corporation, Louisville, Ky.

[21] Appl. No.: 569,338

[22] Filed: Aug. 20, 1990

[51] Int. Cl.[5] ..... B65D 85/10

[52] U.S. Cl. ..... 206/247; 206/459; 206/807

[58] Field of Search ..... 206/807, 247, 459

[56] References Cited

U.S. PATENT DOCUMENTS

| | | | |
|---|---|---|---|
| 4,566,627 | 1/1986 | Gendron | 206/807 X |
| 4,614,297 | 9/1986 | Davis et al. | 206/807 X |
| 4,746,052 | 5/1988 | Schmissrauter | 206/807 X |
| 4,911,302 | 3/1990 | Butler | 206/807 X |
| 4,917,288 | 4/1990 | Heitele et al. | 206/807 X |
| 4,972,953 | 11/1990 | Friedman et al. | 206/807 X |

*Primary Examiner*—William I. Price

*Attorney, Agent, or Firm*—Charles G. Lamb

[57] ABSTRACT

A tamper proof package including tamper detecting means on the top and bottom closures indicate if the package has been opened.

3 Claims, 3 Drawing Sheets

TAMPER PROOF PACKAGE

BACKGROUND OF THE INVENTION (a) Field of the Invention

The present invention relates to a tamper proof package. The present invention particularly relates to tamper detecting means for cigarette packages. Even more particularly, the present invention relates to cigarette packages including tamper detecting means integral with at least a bottom or top closure means of the package.

(b) Description of the Prior Art

Various packages which are relevant to the present invention are well known in the prior art. For example, U.S. Pat. No. 4,434,896 teaches a tamper-resistant reclosable package whereby the outer of the two closure panels on both the top and bottom of the package contains two curved cuts. The outer closure panel overlaps the inner closure panel and is glued to it. Because of the two curved cuts, the closures will tear or disfigure if the package is tampered with.

U.S. Pat. No. 4,479,588 teaches a sealed carton which cannot be opened without indicating tampering. An inner closure panel and an outer closure panel, at least one of which is provided with an arrangement of weakening lines, are overlapped and adhesively bonded.

U.S. Pat. No. 4,508,226 teaches a paperboard sealed carton with tamper indicating features. Two full closure flaps containing weakened areas are at each end of the carton. After these flaps have been overlapped and sealed, any attempt to open one end of the carton will result in a rupture of one of the full closure flaps, thus indicating tampering.

U.S. Pat. No. 4,573,634 teaches a one piece tamper-evident paperboard carton having overlapped end flaps secured such that the carton cannot be opened without tearing the paperboard, thus indicating opening. In the carton, the outer tuck flaps attached to the outer closure flaps contain weakened tear lines which separate when the carton is opened.

U.S. Pat. No. 4,746,052 teaches a box or carton wherein the inner flaps have scored areas, such as in the shape of a semicircle, in the skin surfaces. The outer flaps, which overlap the inner flaps, have window apertures, such as in the shape of a circle. After the outer and inner flaps are glued to each other, any attempt to open the box or carton will tear the skin surface of the inner flap. This will be observable through the window aperture in the outer flap and indicates tampering.

In all of the relevant art above, the tamper proof packages are formed by having outer and inner closure means which must be overlapped and glued. Cuts or weakened areas are provided in at least one of the closure means which will tear upon opening to indicate tampering. In contrast, the present invention relates to closure means which abut rather than overlap.

SUMMARY OF THE INVENTION

The object of the present invention is to provide for a tamper proof package. The object of the present invention particularly relates to providing a tamper detecting means for cigarette packages. Even more particularly, the object of the present invention relates to providing cigarette packages including tamper detecting means to indicate if the package has been opened, which are integral with at least a bottom or top closure means of the package.

More particularly, the present invention is for a unitarily constructed tamper proof package comprising: a sheet of material having four parallel adjacent wall panels, said panels being separated by transversely extending score lines therebetween, each panel having a top and bottom closure at opposite ends thereof, said closures being of preselected size so that in a folded condition alternating top closures abut and alternating bottom closures abut, said closures being defined by longitudinally extending score lines between said panels and said closures, adjacent top and bottom closures being in spaced relationship; a transversely extending sealing panel adjacent to one end wall panel, whereby in a packaged condition said sealing panel laps the opposite end wall panel attaching said wall panels in a four-sided package; and tamper detecting means on at least alternating top closures and bottom closures whereby upon opening said package, said tamper detecting means on said selected closures indicates evidence of opening.

BRIEF DESCRIPTION OF THE DRAWINGS

A better understanding of the present invention will be had upon reference to the following description in conjunction with the accompanying drawings wherein.

DETAILED DESCRIPTION OF THE PREFERRED EMBODIMENT

Figure 1:
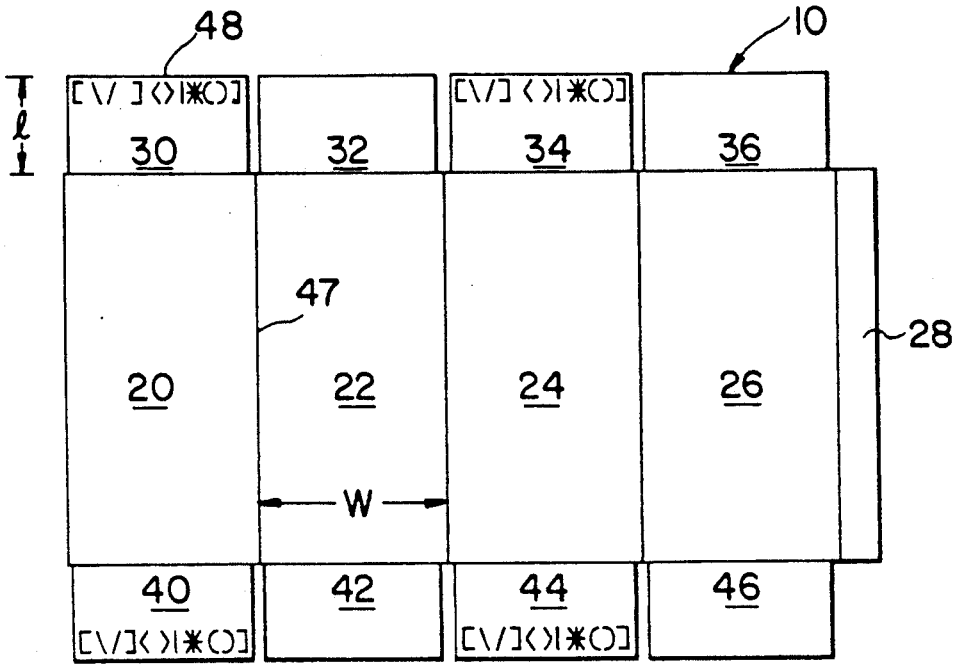
FIG. 1 is a view of the unfolded package with tamper detecting means on two top and bottom closures.

With reference to FIG. 1, there is shown a tamper proof package 10. Package 10 is cut from one piece of material, such as, for example, paperboard, cartonboard, or corrugated facings. Package 10 contains four parallel adjacent wall panels, 20, 22, 24, and 26, and a sealing panel 28 adjacent to and parallel to wall panel 26. Also, each wall panel 20, 22, 24, and 26 has a top and bottom closure at opposite ends. Top closures are 30, 32, 34, and 36, and the bottom closures are 40, 42, 44, and 46. The top and bottom closures are shown with a length one-half the width of the wall panel adjacent to the wall panel to which they are attached. For example, top closure 30 and bottom closure 40 will have a length (1) one-half the width (w) of wall panel 22. As shown, the edges of closures 30 and 34, 32 and 36, 40 and 44, and 42 and 46 will abut when the package is assembled. For this invention, it is only a requirement that the outer two top and bottom closures abut. Depending on the package size and the weight of the object to be packaged, the inside two top and bottom closures can be either short flaps which do not abut or longer flaps which overlap.

There are score lines 47 between wall panels 20 and 22, 22 and 24, and 24 and 26; between wall panel 26 and sealing panel 28; between wall panel 20 and top closure 30; between wall panel 20 and bottom closure 40; between wall panel 22 and top closure 32; between wall panel 22 and bottom closure 42; between wall panel 24 and top closure 34; between wall panel 24 and bottom closure 44; between wall panel 26 and top closure 36; and between wall panel 26 and bottom closure 46. These score lines 47 are provided to make the assembly of package 10 easier by allowing the package material to be bent or folded along the score lines 47. Score lines 47 can be made by any method known in the art, such as, for example, cutting or crimping.

Figure 2:
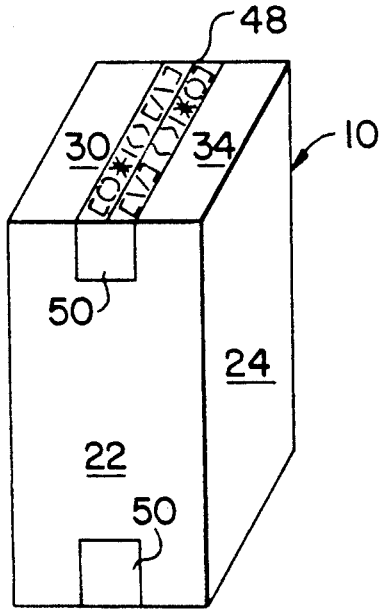
FIG. 2 is a perspective view of a package sealed with sealing tape which covers the tamper detecting means.

Closure panels 30, 34, 40, and 44 show tamper detecting means 48. These panels will be the outside panels when the package 10 is assembled. Tamper detecting means 48 are shown as precut areas along the edges of the panels which will abut when the package is assembled, as can be seen in FIG. 2. Also, as shown in FIG. 2, when the package 10 is assembled, sealing tape 50 is placed over the tamper detecting means 48. Ideally, tamper detecting means 48 will be of shapes which will tear easily when the sealing tape 50 is removed and indicate tampering with package 10. Tamper detecting means 48 may be either one symbol or a mixture of symbols, as shown. It is preferable to have a mixture of symbols to make it more difficult to enter the package from any direction without indicating tampering.

Figure 3:
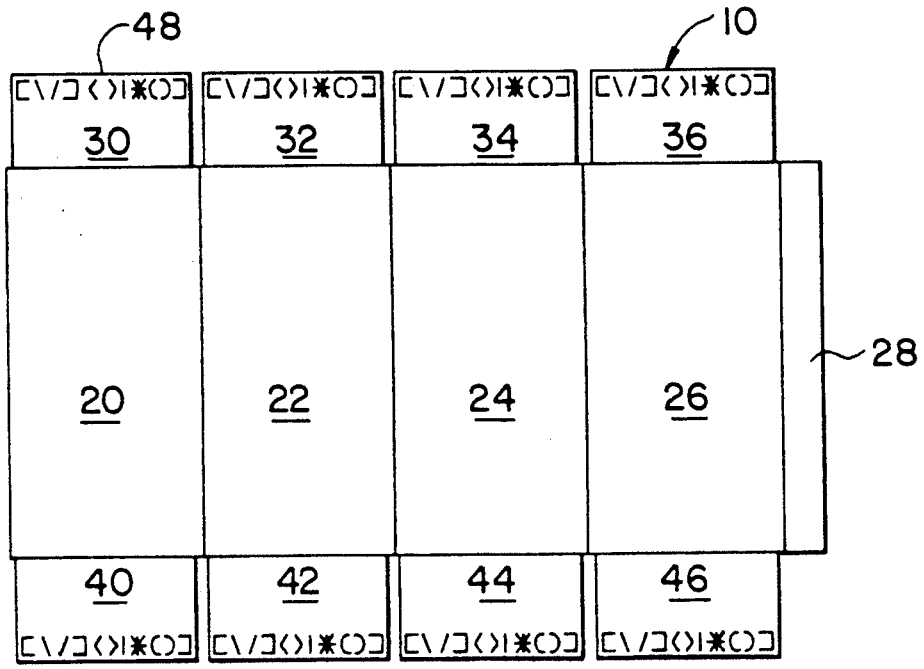
FIG. 3 is a view of the unfolded package with tamper detecting means on all top and bottom closures.

FIG. 3 shows a package having tamper detecting means 48 on all top and bottom closures. This embodiment ensures that tamper detecting means 48 will be on the outside of the package. Therefore, this is the preferred embodiment.

When assembled as a package, sealing panel 28 and wall panel 20 are attached. This attachment is another possible source of entry into the package. In assembling the package, it is possible to place sealing panel 28 inside or outside of the package. In the partially assembled package shown in FIG. 4, sealing panel 28 is designed to be attached inside the package. Tamper detecting means 48 are shown on sealing panel 28. These precut areas are on the same surface of the package material as the tamper detecting means 48 on the closures. Sealing panel 28 and wall panel 20 would be adhesively attached. Any attempt to gain entry to the package through this attachment would be indicated by tears in the tamper detecting means 48.

Figure 4:
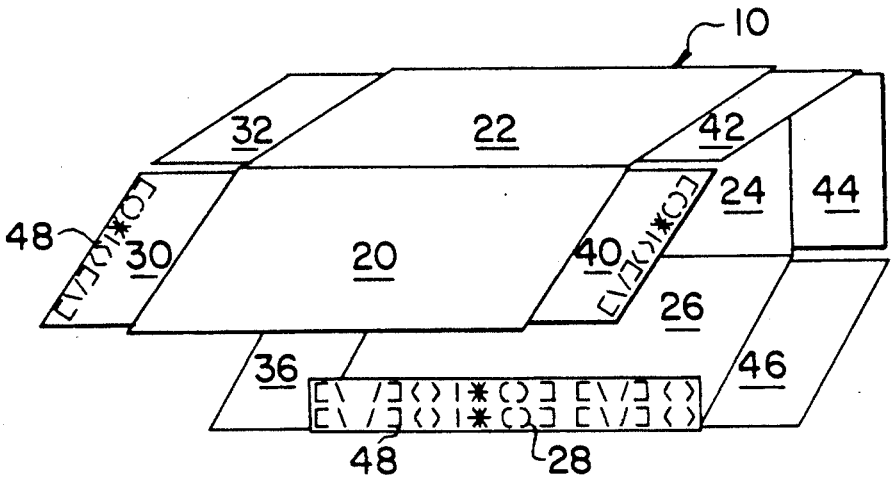
FIG. 4 is a perspective view of a partially folded package whereby the sealing panel with tamper detecting means is to be sealed on the inside of the package; and, FIG. 5 is a perspective view of a partially folded package whereby the sealing panel is to be sealed on the outside of the package.
Figure 5:
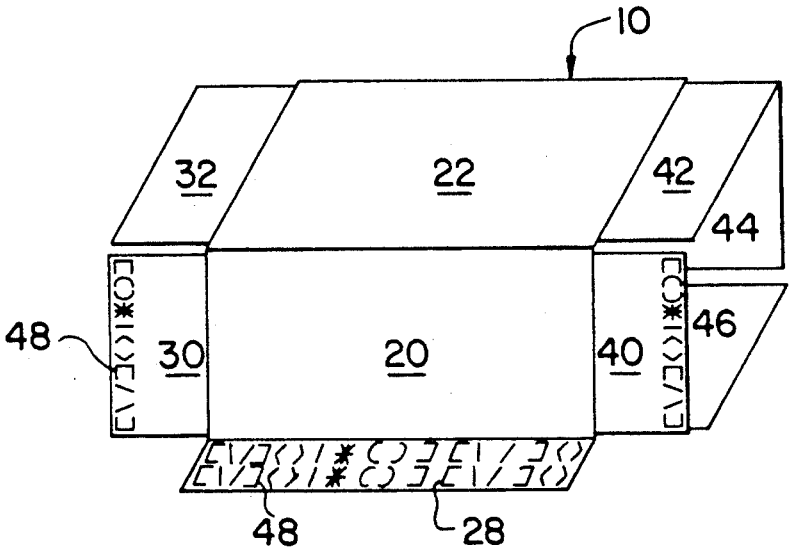

The partially assembled package shown in FIG. 5 is designed for the sealing panel 28 to be placed on the outside of the package. Therefore, in contrast to what is shown in FIG. 4, tamper detecting means 48 on sealing panel 28 are shown on the opposite surface of the package material. As in FIG. 4, sealing panel 28 and wall panel 20 would be adhesively attached and any attempt to gain entry to the package through this attachment would be indicated by tears in the tamper detecting means 48.

The foregoing detailed description is given primarily for clearness of understanding and no unnecessary limitations are to be understood therefrom, for modifications can be made by those skilled in the art upon reading this disclosure, and may be made without departing from the spirit of the invention and scope of the appended claims.

What is claimed is:

1. A unitarily constructed tamper proof package comprising: a sheet of material having four parallel adjacent wall panels, said panels being separated by transversely extending score lines therebetween, each panel having a top and bottom closure at opposite ends thereof, said closures being of preselected size so that in a folded condition alternating top closures abut and alternating bottom closures abut, said closures being defined by longitudinally extending score lines between said panels and said closures, adjacent top and bottom closures being in spaced relationship; a transversely extending sealing panel adjacent to one end wall panel, whereby in a packaged condition said sealing panel laps the opposite end wall panel attaching said wall panels in a four-sided package; and tamper detecting means on at least alternating top closures and bottom closures whereby upon opening said package, said tamper detecting means on said selected closures indicates evidence of opening.

2. The tamper proof package of claim 1 including tamper detecting means on said sealing panel.

3. The tamper proof package of claim 1, said tamper detecting means comprising precut areas along abutting edges of alternating top closures and bottom closures, said package including sealing tape covering said precut areas in a packaged condition.

* * * * *